US009897944B2

(12) United States Patent
Izumiya et al.

(10) Patent No.: US 9,897,944 B2
(45) Date of Patent: Feb. 20, 2018

(54) IMAGE FORMING APPARATUS THAT CORRECTS DEVIATION OF A BELT MEMBER

(71) Applicant: Konica Minolta, Inc., Chiyoda-ku, Tokyo (JP)

(72) Inventors: Yumiko Izumiya, Hachioji (JP); Satoshi Ogata, Hachioji (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/845,732

(22) Filed: Sep. 4, 2015

(65) Prior Publication Data

US 2016/0070221 A1 Mar. 10, 2016

(30) Foreign Application Priority Data

Sep. 8, 2014 (JP) ..... 2014-182004

(51) Int. Cl.
*G03G 15/16* (2006.01)

(52) U.S. Cl.
CPC ..... *G03G 15/1615* (2013.01); *G03G 2215/00156* (2013.01)

(58) Field of Classification Search
CPC ..... G03G 15/50; G03G 15/1615
USPC ..... 399/301
See application file for complete search history.

(56) References Cited

U.S. PATENT DOCUMENTS

2009/0148183 A1* 6/2009 Hildebrand ..... G03G 15/755 399/162

FOREIGN PATENT DOCUMENTS

| | | | |
|---|---|---|---|
| JP | 2006-267953 | A | 10/2006 |
| JP | 2013-092698 | A | 5/2013 |
| JP | 2013-097141 | A | 5/2013 |
| JP | 2014-38270 | A | 2/2014 |

OTHER PUBLICATIONS

Computer translation of applicant cited reference to Ono, JP2013-097141A, publication date: May 20, 2013.*

Office Action (Notice of Reasons for Rejection) dated Sep. 6, 2016, by the Japanese Patent Office in corresponding Japanese Patent Application No. 2014-182004 and an English Translation of the Office Action. (10 pages).

First Office Action issued by the State Intellectual Property Office of the People's Republic of China dated Sep. 29, 2017 in corresponding Chinese Application No. 201510550026.8 with English language translation (12 pages).

* cited by examiner

*Primary Examiner* — Quana M Grainger
(74) *Attorney, Agent, or Firm* — Buchanan Ingersoll & Rooney PC

(57) ABSTRACT

An image forming apparatus includes: a belt member configured to be rotationally operated at least during performance of a job; an adjustment mechanism configured to adjust the position of the belt member; a detection unit configured to detect the position of the belt member; and a control unit configured to control the adjustment mechanism during performance of a job, and perform steering control for correcting deviation of the belt member, the control unit comparing the position of the belt member at the end of a job, and a determination threshold for determining deviation of the belt member from a belt reference position, and selecting a control mode relating to the steering control, according to a result of the comparison.

4 Claims, 4 Drawing Sheets

IMAGE FORMING APPARATUS THAT CORRECTS DEVIATION OF A BELT MEMBER

The entire disclosure of Japanese Patent Application No. 2014-182004 filed on Sep. 8, 2014 including description, claims, drawings, and abstract are incorporated herein by reference in its entirety.

BACKGROUND OF THE INVENTION

Field of the Invention

The present invention relates to an image forming apparatus.

Description of the Related Art

Conventionally, an electrophotographic image forming apparatus is known such as a printer or a copying machine. Particularly, a so-called tandem color image forming apparatus is known in which a plurality of image carriers are disposed in a vertical direction to face one intermediate transfer belt and forming a full color image.

In such an image forming apparatus, an endless belt member, for example the intermediate transfer belt, is mounted, and the belt member is stretched around a plurality of rollers and rotationally operated. When the apparatus or the belt member is distorted, the belt member may meander and deviate during continuous rotational operation. The deviation of the belt member positionally shifts images transferred from the image carriers, and leads to deterioration in quality of the image. Therefore, in the image forming apparatus, steering control for correcting deviation of the belt member generated during performance of a job is performed in order to bring the belt member closer to a belt reference position.

For example, JP 2013-97141 A discloses an image forming apparatus which performs correction of meandering of an intermediate transfer belt corresponding to the steering control. In this image forming apparatus, when an operation command (job) is input, normal drive is started. During the normal drive, correction of meandering is performed using a first meandering correction mode. In the first meandering correction mode, a meandering correction unit is driven, based on a meandering direction and a meandering amount which are obtained by monitoring the intermediate transfer belt, and the intermediate transfer belt is returned to an appropriate position during rotational operation of the intermediate transfer belt. As a result of the meandering correction using the first meandering correction mode, when an edge position is less than a predetermined threshold, the process returns to the first meandering correction mode, and when the edge position is not less than the threshold, the meandering correction is performed by a maximum amount of correction.

However, in such an image forming apparatus, deviation of the belt member may be gradually accumulated, and even if the steering control is performed, large deviation may be generated in the belt member. For example, short-time jobs intermittently performed significantly bring about such a problem. Further, when the large deviation is generated, correction operation is performed by a large amount of control, in view of protection of the belt, as disclosed in JP 2013-97141 A. However, the correction operation is performed even during performance of the job, and thus, the correction operation results in the problem that the image quality is deteriorated and an output object is useless.

SUMMARY OF THE INVENTION

The present invention has been made in view of such circumstances, and an object of the present invention is to provide an image forming apparatus appropriately correcting deviation of a belt member, while inhibiting image deterioration resulting from the correction of the deviation of the belt member.

To achieve the abovementioned object, according to an aspect, an image forming apparatus reflecting one aspect of the present invention comprises a belt member configured to be rotationally operated at least during performance of a job, an adjustment mechanism configured to adjust the position of the belt member, a detection unit configured to detect the position of the belt member, and a control unit configured to control the adjustment mechanism during performance of a job, and perform steering control for correcting deviation of the belt member. In the image forming apparatus, the control unit preferably compares the position of the belt member at the end of the job, and a determination threshold for determining deviation of the belt member from a belt reference position, and selects a control mode relating to the steering control, according to a result of the comparison.

In the image forming apparatus according to an embodiment of the present invention, when the position of the belt member at the end of a job is within the determination threshold, the control unit preferably selects a first control mode of finishing a job to stop the steering control, and when the position of the belt member at the end of the job is larger than the determination threshold, the control unit preferably selects a second control mode of determining a control mode according to a set job.

Further, in the image forming apparatus according to an embodiment of the present invention, the control unit preferably calculates an estimated return position of the belt member assuming that a set job is performed, in the second control mode. At that time, when there is no set job, or when there is a set job but the estimated return position of the belt member is larger than the determination threshold, the control unit preferably performs correction operation of returning the position of the belt member within the determination threshold, and then finishes the job to stop the steering control, or when there is a set job, and the estimated return position of the belt member is within the determination threshold, the control unit preferably finishes the job to stop the steering control.

Further, in the image forming apparatus according to an embodiment of the present invention, the control unit preferably calculates the estimated return position of the belt member, based on a time of rotational operation of the belt member during performance of a set job, and an amount of movement of the belt member per unit time in the steering control.

Further, in the image forming apparatus according to an embodiment of the present invention, when the correction operation is performed, the control unit preferably controls the adjustment mechanism by a larger amount of control than a normal amount of control performed in the steering control.

Further, in the image forming apparatus according to an embodiment of the present invention, the amount of movement of the belt member per unit time in the steering control is preferably a preset value or a value calculated based on the steering control performed during performance of a job.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described with reference to the drawings. However, the scope of the invention is not limited to the illustrated examples.

Figure 1:
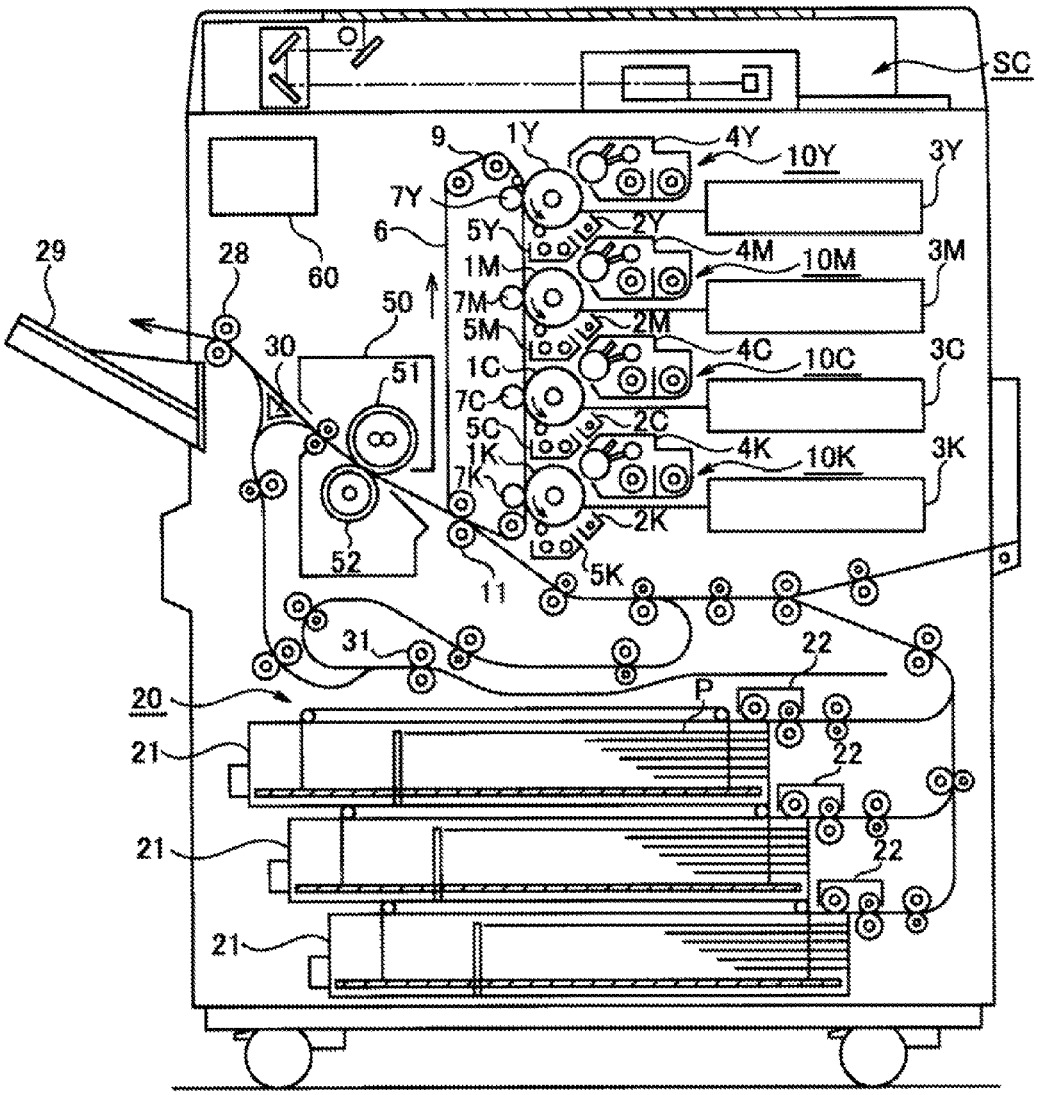
FIG. 1 is a schematic diagram illustrating an image forming apparatus according to an embodiment.

FIG. 1 is a schematic diagram illustrating an image forming apparatus according to the present embodiment. The image forming apparatus is, for example an electrophotographic image forming apparatus such as a copying machine, and is so-called tandem color image forming apparatus having a plurality of photoreceptors disposed in a vertical direction to face one intermediate transfer belt and forming a full color image.

The image forming apparatus includes a document reader SC, four sets of image forming units 10Y, 10M, 10C, and 10K, a fuser 50, and a control unit 60.

The document reader SC scans and exposes an image of a document by an optical system of a scanning exposure device, and reads reflected light from the image by a line image sensor to obtain an image signal. The image signal is subjected to processing such as A/D conversion, shading correction, or compression, and then is input as image data to the control unit 60. The image data input to the control unit 60 is not limited to data read by the document reader SC, and may be data received from a personal computer connected to the image forming apparatus, or received from another image forming apparatus.

The four image forming units 10Y, 10M, 10C, and 10K include the image forming unit 10Y configured to form a yellow (Y) image, the image forming unit 10M configured to form a magenta (M) image, the image forming unit 10C configured to form a cyan (C) image, and the image forming unit 10K configured to form a black (K) image.

The image forming unit 10Y includes a photoreceptor drum 1Y and a charging unit 2Y disposed at a position around the photoreceptor drum 1Y, an optical writing unit 3Y, a developing device 4Y, and a drum cleaner 5Y. Similarly, the image forming unit 10M, 10C, and 10K include photoreceptor drums 1M, 1C, and 1K, charging units 2M, 2C, and 2K disposed at a position around the photoreceptor drums 1M, 1C, and 1K, optical writing units 3M, 3C, and 3K, developing devices 4M, 4C, and 4K, and drum cleaners 5M, 5C, and 5K.

The photoreceptor drums 1Y, 1M, 1C, and 1K have surfaces uniformly charged by the charging units 2Y, 2M, 2C, and 2K, to form latent images on the photoreceptor drums 1Y, 1M, 1C, and 1K through the scanning and exposure by the optical writing units 3Y, 3M, 3C, and 3K. Further, the developing devices 4Y, 4M, 4C, and 4K develop the latent images on the photoreceptor drums 1Y, 1M, 1C, and 1K with toner for visualization. Therefore, images (toner images) each having a predetermined color corresponding to any of yellow, magenta, cyan, and black, on the photoreceptor drums 1Y, 1M, 1C, and 1K. The image formed on the photoreceptor drums 1Y, 1M, 1C, and 1K are sequentially transferred by primary transfer rollers 7Y, 7M, 7C, and 7K to predetermined positions on the intermediate transfer belt 6 as an endless belt member.

Figure 2:
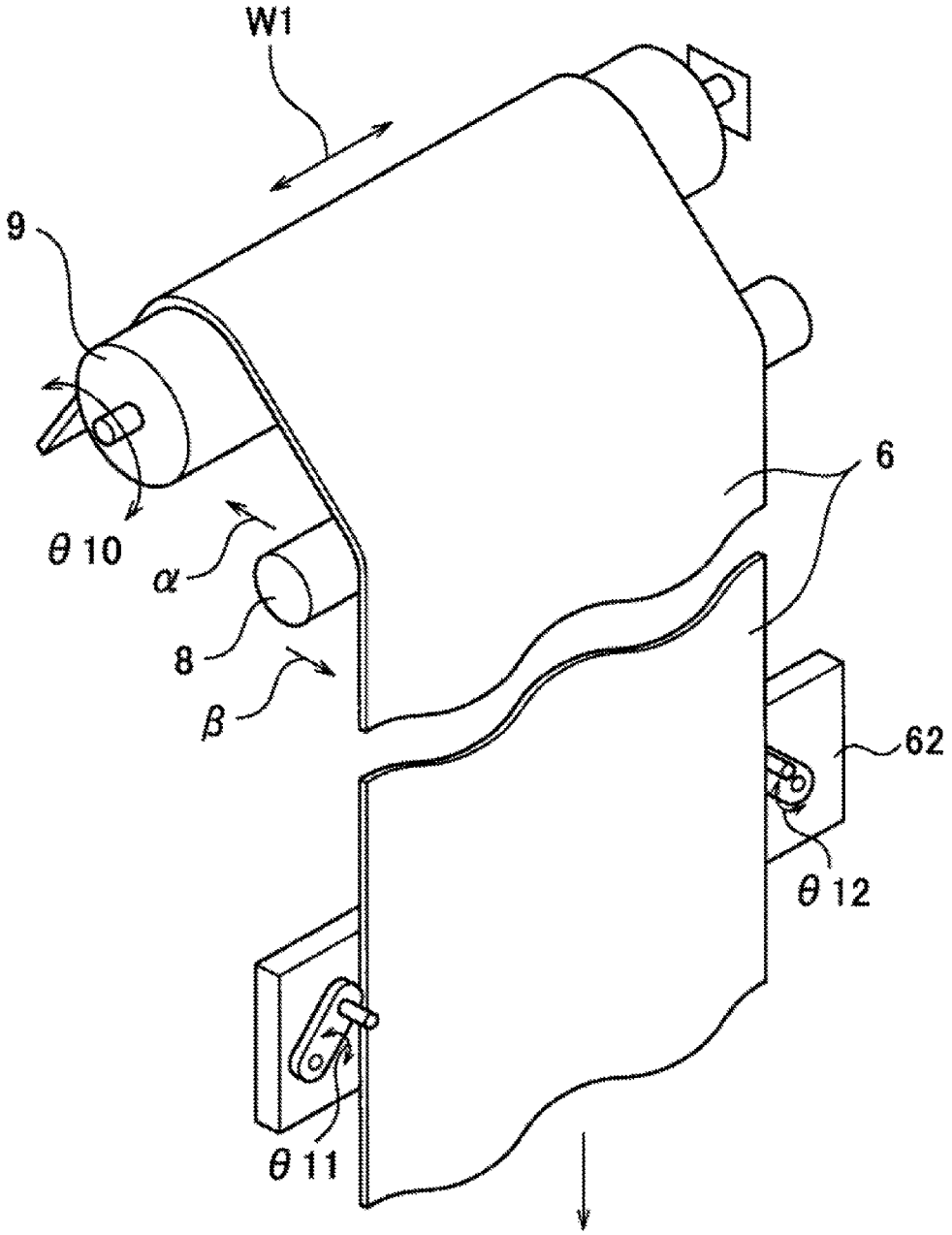
FIG. 2 is a schematic perspective view illustrating a main part of the image forming apparatus concentrating on an intermediate transfer belt.

FIG. 2 is a schematic perspective view illustrating a main part of the image forming apparatus around the intermediate transfer belt 6. The intermediate transfer belt 6 is the belt member stretched around a pressure roller 8, a steering roller 9, and the other rollers (not illustrated), and is rotationally operated at least during performance of a job.

The pressure roller 8 is configured to be switched between a compression position and a release position. A compression state in which the intermediate transfer belt 6 makes pressure contact with the photoreceptor drums 1Y, 1M, 1C, and 1K, and a release state in which the intermediate transfer belt 6 separates from the photoreceptor drums 1Y, 1M, 1C, and 1K are switched to each other according to the switching between the compression position and the release position. Specifically, when the pressure roller 8 is at the compression position, the intermediate transfer belt 6 is set to the compression state. When the pressure roller 8 is moved from the compression position to the release position in an $\alpha$ direction, the intermediate transfer belt 6 is switched from the compression state to the release state. Further the pressure roller 8 is moved from the release position to the compression position in a $\beta$ direction, the intermediate transfer belt 6 is switched from the release state to the compression state. During performance of a job (during image formation), the pressure roller 8 is set to the compression position, and the image is allowed to be transferred from the photoreceptor drums 1Y, 1M, 1C, and 1K to the intermediate transfer belt 6. The pressure roller 8 is connected to a pressure roller driving unit 64 (see FIG. 3), and when the pressure roller driving unit 64 is driven, the compression position and the release position are switched to each other.

Figure 3:
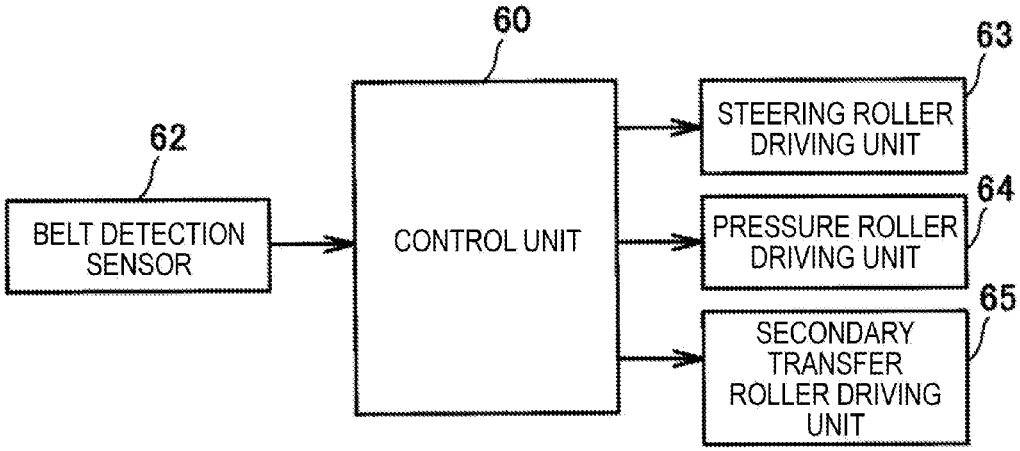
FIG. 3 is a block diagram illustrating a functional configuration of a control system of the image forming apparatus.

The steering roller 9 has one end side supported by a support member, and the other end side connected to a steering roller driving unit 63 (see FIG. 3). When the steering roller driving unit 63 is driven, the other end side of the steering roller 9 is moved in a circular direction (turning direction $\theta$10) with the one end side as a fulcrum. Movement of the other end side of the steering roller 9 can change an inclination angle of the steering roller 9. The change of the inclination angle of the steering roller 9 can adjust the position of the intermediate transfer belt 6 in a width direction (direction perpendicular to a running direction of the intermediate transfer belt 6) W1. For example, when the steering roller 9 is inclined to one side along the turning direction $\theta$10, the intermediate transfer belt 6 is moved to a back side (one end side of the steering roller 9). Further when the steering roller 9 is inclined to the other side along the turning direction $\theta$10, the intermediate transfer belt 6 is moved to a front side (the other end side of the steering roller 9). As described above, the steering roller 9 and the steering roller driving unit 63 function as an adjustment mechanism for adjusting the deviation of the intermediate transfer belt 6.

Referring to FIG. 1 again, the images of respective colors having been transferred to the intermediate transfer belt 6 are transferred, by a transfer member, to paper sheets P conveyed with predetermined timing by the sheet conveying unit 20. The transfer member includes a secondary transfer roller 11 being for example a roller-shaped rotation member.

The secondary transfer roller 11 can be switched between a compression state in which the secondary transfer roller 11 makes pressure contact with the intermediate transfer belt 6, and a release state in which the secondary transfer roller 11 separates from the intermediate transfer belt 6. The secondary transfer roller 11 is set to the compression state during performance of a job (during image formation). When the paper sheet P passes through a nip portion (hereinafter referred to as "secondary transfer nip portion") between the intermediate transfer belt 6 and the secondary transfer roller 11, the image on the intermediate transfer belt 6 is transferred to the paper sheet P. The secondary transfer roller 11 is connected to a secondary transfer roller driving unit 65 (see FIG. 3), and the pressure roller driving unit 64 is driven to switch the compression position and the release position to each other.

The sheet conveying unit 20 conveys the paper sheet P along a conveyance path. The paper sheets P are stored in a paper input tray 21, and a paper sheet P stored in the paper input tray 21 is taken up by a paper feed unit 22, and sent to the conveyance path. The conveyance path is provided with a plurality of conveyance units for conveying the paper sheet P. Each conveyance unit includes a pair of rollers making pressure contact with each other, and at least one of the rollers is rotationally driven through a drive mechanism mainly including an electric motor.

The fuser 50 is a device for performing fusing processing of fusing the image on the paper sheet P conveyed from the secondary transfer nip portion. The fuser 50 includes, for example, fusing rollers 51 and 52 being a pair of fusing members making pressure contact with each other, and a heater for heating one or both of the fusing rollers 51 and 52. In a process of conveying the paper sheet P, the fuser 50 passes the paper sheet P through the nip portion between the pair of fusing rollers 51 and 52, so that the image is fused on the paper sheet P by pressure of the nip portion and heat of the fusing rollers 51 and 52 (fusing processing).

The paper sheet P subjected to the fusing processing by the fuser 50 is output into a paper output tray 29 mounted on an outer side surface of a housing, by paper output rollers 28. Further, when the image is formed also on the back side of the paper sheet P, the paper sheet P having a surface on which the image has been formed is conveyed by a switching gate 30 to reverse rollers 31 positioned below the switching gate 30. The reverse rollers 31 hold a rear end of the conveyed paper sheet P, feeds the paper sheet P backward to reverse the paper sheet P, and sends the paper sheet to a conveyance path for refeeding paper. The paper sheet P sent to the conveyance path for refeeding paper is conveyed by a plurality of conveyance units for refeeding paper, and the paper sheet P is returned to the secondary transfer nip portion.

The control unit 60 functions to control the image forming apparatus, and can use, for example, a microcomputer mainly including a CPU, a ROM, a RAM, and an I/O interface.

FIG. 3 is a block diagram illustrating a functional configuration of a control system of the image forming apparatus according to the present embodiment. In the present embodiment, the control unit 60 controls the pressure roller driving unit 64 to switch a state of the intermediate transfer belt 6 relative to the photoreceptor drums 1Y, 1M, 1C, and 1K between the compression state and the release state. Further, the control unit 60 controls the secondary transfer roller driving unit 65 to switch a state of the secondary transfer roller 11 relative to the intermediate transfer belt 6 between the compression state and the release state. Such switching is performed according to an operation pattern previously set according to an operation condition of the image forming apparatus.

The control unit 60 performs steering control for bringing the intermediate transfer belt 6 closer to a belt reference position being a predetermined reference position of the intermediate transfer belt 6. The steering control is performed during performance of a job in which the intermediate transfer belt 6 is rotationally operated, and controls the inclination angle of the steering roller 9, according to a deviation between the position of the intermediate transfer belt 6 and the belt reference position.

In order to perform the steering control, a detection signal is input to the control unit 60 from a belt detection sensor 62. The belt detection sensor 62 is a detection unit for detecting the position of the intermediate transfer belt 6, and is fixedly disposed in the vicinity of the intermediate transfer belt 6. In the present embodiment, as illustrated in FIG. 2, the belt detection sensor 62 includes two levers 62*a* and 62*b*, and detects end positions of the intermediate transfer belt 6 (hereinafter simply referred to as "belt position") in a width direction W1, based on turning angles θ11 and θ12 of the levers 62*a* and 62*b*. The control unit 60 can recognize an amount and direction of deviation of the intermediate transfer belt from the belt reference position, based on the belt position detected by the belt detection sensor 62.

Further, in the present embodiment, the control unit 60 is configured to compare the position of the intermediate transfer belt 6 at the end of a job and a first determination threshold, and select a control mode relating to the steering control according to a result of the comparison. Specifically, when the position of the intermediate transfer belt 6 at the end of the job is within the first determination threshold, the control unit 60 selects a first control mode of finishing a job to stop the steering control. Whereas, when the position of the intermediate transfer belt 6 at the end of the job is larger than the first determination threshold, the control unit 60 selects a second control mode of determining a control mode according to a set job.

In the second control mode, when there is no set job, or when there is a set job but an estimated return position of the intermediate transfer belt 6 is larger than the first determination threshold, after forcible correction operation of returning the position of the intermediate transfer belt 6 within the first determination threshold is performed, the control unit 60 finishes the job to stop the steering control. Here, the estimated return position of the intermediate transfer belt 6 represents the position of the intermediate transfer belt 6 estimated in consideration of the rotational operation and the steering control of the intermediate transfer belt 6, assuming that a set job is performed, and the estimated return position is calculated by the control unit 60.

Whereas, in the second control mode when there is a set job, and the estimated return position of the intermediate transfer belt 6 is within the first determination threshold, the control unit 60 finishes the job to stop the steering control.

Figure 4:
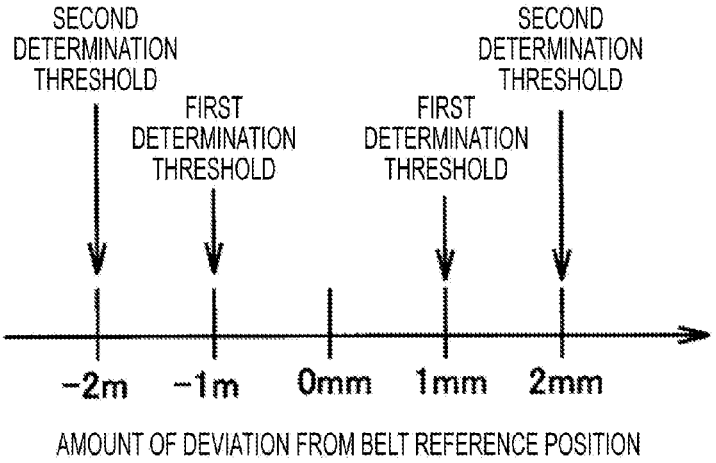
FIG. 4 is an explanatory diagram of determination thresholds.

Here, FIG. 4 is an explanatory diagram of the determination thresholds. The first determination threshold represents a threshold for determining a deviation of the intermediate transfer belt 6 from the belt reference position, and is previously set in consideration of a configuration of the apparatus, image quality required, or the like. When the belt position is within the first determination threshold, it is determined that the belt position is at a normal position, and when the belt position is larger than the first determination threshold, it is determined that the belt position is deviated out of the normal position. Further the second determination threshold represents a threshold set to a larger amount of deviation than the first determination threshold in view of protection of the intermediate transfer belt 6 or the apparatus, and is previously set in consideration of the configuration of the apparatus. When the belt position is larger than the second determination threshold, operation of the image forming apparatus is stopped.

Figure 5:
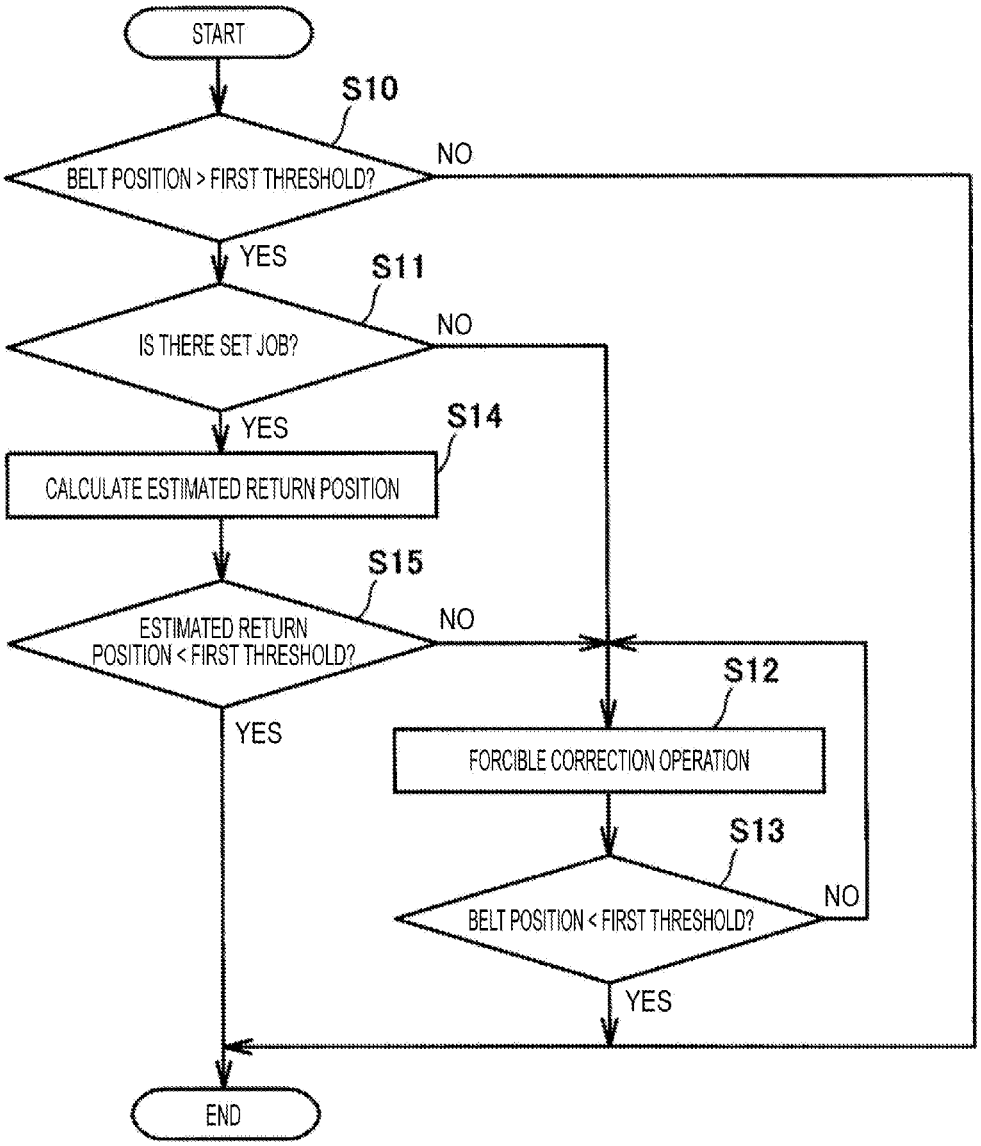
FIG. 5 is a flowchart illustrating a control procedure of the image forming apparatus according to the embodiment.

FIG. 5 is a flowchart illustrating a control procedure of the image forming apparatus according to the present embodiment. Processing illustrated in the flowchart is performed by the control unit 60, based on the finish of image formation on the last paper sheet in performance of a job. That is, the processing illustrated in the flowchart of FIG. 5 is achieved by executing a program stored in a ROM by a CPU. Further, on the assumption that the processing illustrated in the flowchart is performed, the control unit 60 starts the rotational operation of the intermediate transfer belt 6 accompanying the performance of the job, and starts the steering control with the rotational operation of the intermediate transfer belt 6. During performance of the job, the control unit 60 monitors the detection signal from the belt detection sensor 62, and controls the inclination angle of the steering roller 9 according to the deviation between the belt position and the belt reference position.

In step 10 (S10), when reading the detection signal from the belt detection sensor 62 before finishing the job, the control unit 60 determines whether the belt position at the end of the job (amount of deviation from the belt reference position) is larger than the first threshold. When the belt position is larger than the first threshold, an affirmative determination is made in step 10, and the processing proceeds to step 11 (S11). Whereas, when the belt position is within the first threshold, a negative determination is made in step 10, and the processing ends (END). When the processing ends, the control unit 60 finishes the job to stop the steering control.

In step 11, the control unit 60 determines whether there is a set job. When there is a set job, an affirmative determination is made in step 11, and the processing proceeds to step 14 (S14) described below. While, when there is no set job, a negative determination is made in step 11, and the processing proceeds to step 12 (S12).

In step 12, the control unit 60 performs the forcible correction operation of the intermediate transfer belt 6. The forcible correction operation represents operation of controlling the inclination angle of the steering roller 9, while continuing rotational operation of the intermediate transfer belt 6 even after the finish of image formation on the last paper sheet, and bringing the intermediate transfer belt 6 closer to the belt reference position. Further, in the forcible correction operation, the inclination angle of the steering roller 9 is controlled by a larger amount of control than a normal amount of control performed in the steering control, or an amount of control in the steering control performed during performance of the job. When the forcible correction operation is performed, it is preferable that the intermediate transfer belt 6 is separated from the photoreceptor drums 1Y, 1M, 1C, and 1K, and the secondary transfer roller 11 is separated from the intermediate transfer belt 6.

In step 13 (S13), when the detection signal is read from the belt detection sensor 62, the control unit 60 determines whether the belt position is less than the first threshold. When the belt position is less than the first threshold, an affirmative determination is made in step 13, and the processing ends (END). Whereas, when the belt position is not less than the first threshold, a negative determination is made in step 13, and the processing returns to step 12.

In step 14, the control unit 60 calculates the estimated return position of the intermediate transfer belt 6, based on the set job. When the set job is performed, the steering control is performed even during performance of the job. Therefore, when it is assumed that the set job is performed, it is estimated how much the intermediate transfer belt 6 is returned toward the belt reference position by calculating the estimated return position of the intermediate transfer belt 6.

The control unit 60 calculates a time of rotational operation of the intermediate transfer belt 6 during performance of the set job, based on information about the contents of the set job, for example, the number of sheets to be printed, the number of copies to be printed, one-side printing or both side printing, and a process linear velocity. Then, the control unit 60 calculates the estimated return position of the intermediate transfer belt 6, based on the time of rotational operation of the intermediate transfer belt 6, and an amount of returning of the intermediate transfer belt 6 per unit time resulting from the steering control. Further when there are a plurality of set jobs, the control unit 60 calculates an estimated return position of the intermediate transfer belt 6 for each set job, and defines a total of the estimated return positions as the estimated return position.

Here, the control unit 60 can previously hold, as a design value, the amount of returning of the intermediate transfer belt 6 per unit time resulting from the steering control. Further, the amount of returning of the intermediate transfer belt 6 may be measured during actual performance of a job to use a value of the measurement.

In step 15 (S15), the control unit 60 determines whether the estimated return position of the intermediate transfer belt 6 is less than the first threshold. When the calculated, estimated return position of the intermediate transfer belt 6 is less than the first threshold, an affirmative determination is made in step 15, and the processing ends (END). When the processing ends, the control unit 60 finishes the job to stop the steering control. Whereas, when the estimated return position of the intermediate transfer belt 6 is not less than the first threshold, a negative determination is made in step 15, and the processing returns to step 12.

As described above, according to the present embodiment, the image forming apparatus includes the intermediate transfer belt 6 configured to be rotationally operated at least during performance of a job, the steering roller 9 configured to adjust the position of the intermediate transfer belt 6, the belt detection sensor 62 configured to detect the position of the intermediate transfer belt 6, and the control unit 60 configured to control the steering roller 9 during performance of a job, and perform steering control for correcting deviation of the intermediate transfer belt 6. Here, the control unit 60 compares the position of the intermediate transfer belt 6 at the end of the job, and the first determination threshold for determining deviation of the intermediate transfer belt 6 from the belt reference position, and selects the control mode relating to the steering control, according to a result of the comparison.

When the intermediate transfer belt 6 has a deviation, the steering control is basically performed during performance of a job, and the deviation can be corrected. However, in order to correct the deviation by the steering control, the steering control needs to be performed continuously over a certain period. Therefore, when short-time jobs are intermittently performed, deviation of the intermediate transfer belt 6 is gradually accumulated, in addition to insufficient correction of the deviation in each job, and as a result, large deviation may be generated in the intermediate transfer belt 6.

On that point, according to an embodiment of the present invention, a control mode for correction of the large deviation caused by the accumulation can be appropriately selected, by focusing on the position of the intermediate transfer belt 6 at the end of a job. Further, since the selection in which the control modes may be switched from to each other is made at the end of the job, switching of the control modes during performance of the job can be inhibited. Therefore, while reducing the deviation of the intermediate transfer belt 6, image deterioration resulting from the correction can be inhibited.

Further, in the present embodiment, when the position of the intermediate transfer belt 6 at the end of the job is within the first determination threshold, the control unit 60 selects a first control mode of finishing a job to stop the steering control. Further, when the position of the intermediate transfer belt 6 at the end of the job is larger than the first determination threshold, the control unit 60 selects the second control mode of determining a control mode according to a set job.

According to this configuration, when the position of the intermediate transfer belt 6 is within the first determination threshold, the steering control is performed only during performance of the job. Whereas, even in such a control mode, when the deviation of the intermediate transfer belt 6 accumulates and the position of the intermediate transfer belt 6 is larger than first determination threshold, the control mode is determined according to a set job. Therefore, the large deviation caused by the accumulation can be appropriately corrected by determining a control mode in consideration of a set job being a job subsequently performed.

Further, in the present embodiment, when there is no set job, or when there is a set job but an estimated return position of the intermediate transfer belt 6 is larger than the first determination threshold, after forcible correction operation of returning the position of the intermediate transfer belt 6 within the first determination threshold is performed, the control unit 60 finishes the job to stop the steering control. Whereas, when there is a set job, and the estimated return position of the intermediate transfer belt 6 is within the first determination threshold, the control unit 60 finishes the job to stop the steering control.

According to this configuration, when there is no set job, or when the deviation of the intermediate transfer belt 6 is not corrected even by the steering control during performance of a set job, the forcible correction operation is performed at the end of a current job. By this forcible correction operation, the deviation of the intermediate transfer belt 6 can be appropriately corrected. Further, since the forcible correction operation is not performed during actual image formation, the image deterioration resulting from the correction can be inhibited. Whereas, when the deviation of the intermediate transfer belt 6 is corrected in the steering control performed during performance of a set job, the forcible correction operation is not performed. Therefore, performance of unnecessary forcible correction operation can be inhibited, and generation of a downtime is inhibited.

Further, in the present embodiment, the control unit 60 calculates the estimated return position of the intermediate transfer belt 6, based on the time of rotational operation of the intermediate transfer belt 6 during performance of a set job, and the amount of returning of the intermediate transfer belt 6 per unit time in the steering control. Therefore, the estimated return position of the intermediate transfer belt 6 can be appropriately obtained.

Further, in the present embodiment, when the correction operation is performed, the control unit 60 controls the steering roller 9 by the larger amount of control than the normal amount of control performed in the steering control. Since the forcible correction operation is performed at the timing that the image formation is finished, even if control is performed by a large amount of control, image deterioration can be inhibited.

Although the image forming apparatus according to an embodiment of the present invention has been described, the present invention is not limited to the above-mentioned embodiment, and it is apparent that various modifications may be made without departing from the scope of the invention.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming apparatus comprising:

a belt member configured to be rotationally operated at least during performance of a job;

an adjustment mechanism configured to adjust the position of the belt member;

a detection unit configured to detect the position of the belt member; and a control unit configured to control the adjustment mechanism during performance of a job, and perform steering control for correcting deviation of the belt member, the control unit comparing the position of the belt member at the end of a job after image formation on the last paper sheet in the job is finished and before a next job is started, with a determination threshold for determining deviation of the belt member from a belt reference position, and selecting a control mode relating to the steering control according to a result of the comparison;

wherein, when the position of the belt member at the end of a job is within the determination threshold, the control unit selects a first control mode of finishing a job to stop the steering control, and when the position of the belt member at the end of the job is larger than the determination threshold, the control unit selects a second control mode of determining a control mode according to a set job wherein, the control unit calculates an estimated return position of the belt member assuming that a set job is performed, in the second control mode, and when there is no set job, or when there is a set job but the estimated return position of the belt member is larger than the determination threshold, the control unit performs correction operation of returning the position of the belt member within the determination threshold, and then finishes the job to stop the steering control, or when there is a set job, and the estimated return position of the belt member is within the determination threshold, the control unit finishes the job to stop the steering control.

2. The image forming apparatus according to claim 1, wherein the control unit calculates the estimated return position of the belt member, based on a time of rotational operation of the belt member during performance of a set job, and an amount of movement of the belt member per unit time in the steering control.

3. The image forming apparatus according to claim 1, wherein, when the correction operation is performed, the control unit controls the adjustment mechanism by a larger amount of control than a normal amount of control performed in the steering control.

4. The image forming apparatus according to claim 2, wherein the amount of movement of the belt member per unit time in the steering control is a preset value or a value calculated based on the steering control performed during performance of a job.

* * * * *